US008366188B2

(12) United States Patent
Adams et al.

(10) Patent No.: US 8,366,188 B2
(45) Date of Patent: Feb. 5, 2013

(54) RELEASE SYSTEM FOR FURNITURE MEMBER LEG REST ASSEMBLIES

(75) Inventors: Chad E. Adams, Perrysburg, OH (US); Larry P. LaPointe, Temperance, MI (US); Eric B. Harwood, Toledo, OH (US); Richard E. Marshall, Monroe, MI (US); Michael R. Mero, Jr., Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 407 days.

(21) Appl. No.: 12/759,285

(22) Filed: Apr. 13, 2010

(65) Prior Publication Data

US 2011/0248544 A1 Oct. 13, 2011

(51) Int. Cl.
*A47C 1/02* (2006.01)

(52) U.S. Cl. ..... 297/85 R; 297/85 M; 297/85 L; 297/423.3; 297/69

(58) Field of Classification Search ..... 297/85, 297/423.3, 69
See application file for complete search history.

(56) References Cited

U.S. PATENT DOCUMENTS

| | | | | |
|---|---|---|---|---|
| 3,325,210 | A | 6/1967 | Knabusch et al. | |
| 4,621,863 | A * | 11/1986 | Jackson et al. | 297/85 M |
| 4,674,794 | A * | 6/1987 | Pine | 297/85 M |
| 4,681,365 | A * | 7/1987 | Pine | 297/85 M |
| 4,919,478 | A * | 4/1990 | Tacker | 297/85 R |
| 5,088,789 | A | 2/1992 | LaPointe et al. | |
| 5,141,284 | A | 8/1992 | LaPointe | |
| 5,156,441 | A | 10/1992 | Byersmith et al. | |
| 5,570,927 | A | 11/1996 | LaPointe et al. | |
| 5,597,210 | A | 1/1997 | Pickard | |
| 6,655,732 | B1 | 12/2003 | LaPointe | |
| 6,893,085 | B2 * | 5/2005 | LaPointe et al. | 297/85 M |
| 7,338,132 | B2 | 3/2008 | LaPointe | |
| 2010/0052395 | A1 | 3/2010 | Anglese | |

FOREIGN PATENT DOCUMENTS

WO WO 2007-022190 2/2007

OTHER PUBLICATIONS

International Search Report for International Application No. PCT/US2011/029590 mailed Nov. 29, 2011.
Written Opinion of the International Searching Authority for Internatonal Application No. PCT/US2011/029590 mailed Nov. 29, 2011.

* cited by examiner

*Primary Examiner* — Laurie Cranmer
(74) *Attorney, Agent, or Firm* — Harness, Dickey & Pierce, P.L.C.

(57) ABSTRACT

A release system for a furniture member leg rest assembly extended from an actuation mechanism includes an actuation mechanism, the actuation mechanism having a leg rest assembly movable between a fully retracted and a plurality of extended positions inclusive, including a fully extended position. A pantograph link of the leg rest assembly is rotatably connected to the actuation mechanism. An extension link is rotatably connected to the actuation mechanism and moves in extension and retraction directions. A member is in contact with the extension link and in releasable contact with the pantograph link. The member is in contact with the pantograph link when the member is operating to push the pantograph link outward toward the fully extended position. The member is spatially separable from the pantograph link when an object is contacted by the leg rest assembly during return from any of the extended positions toward the fully retracted position.

28 Claims, 16 Drawing Sheets

FIG 14
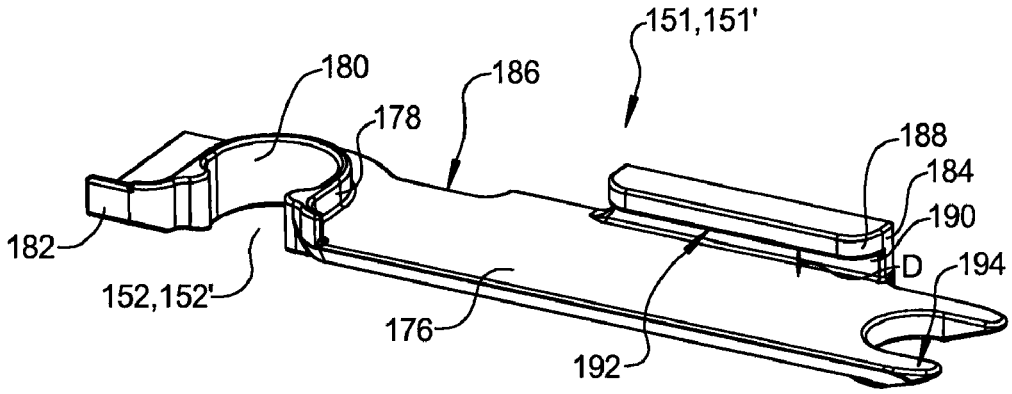
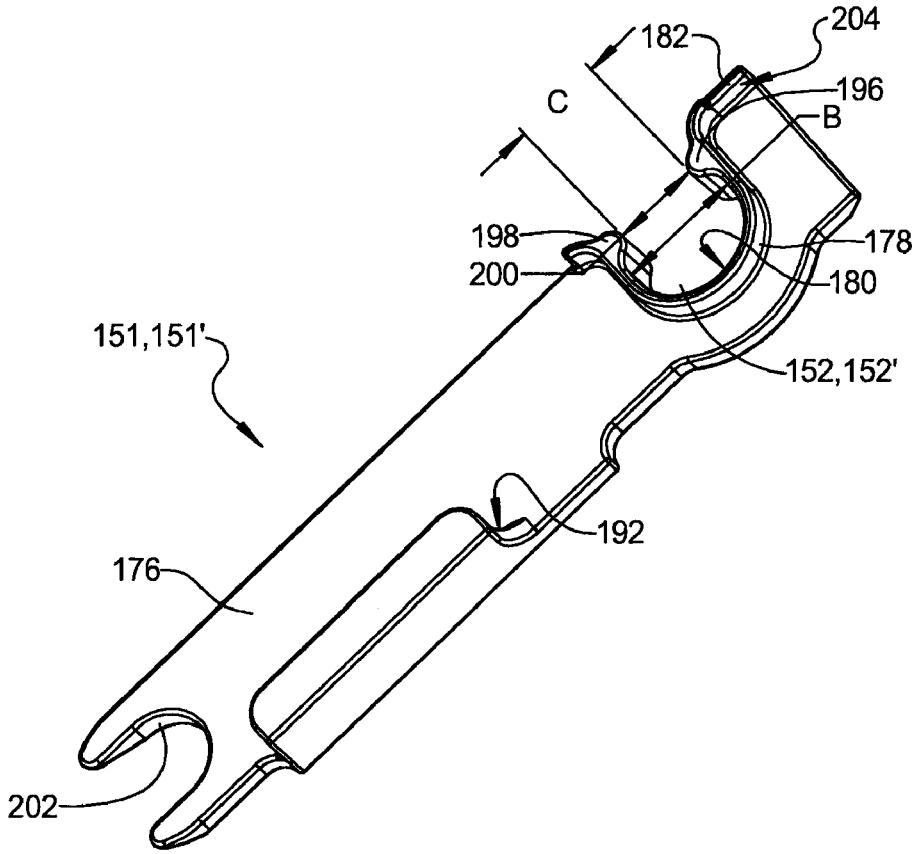
FIG 15

RELEASE SYSTEM FOR FURNITURE MEMBER LEG REST ASSEMBLIES

FIELD

The present disclosure relates to systems and devices for freely releasing a furniture member leg rest assembly during downward motion upon encountering an object in the path of leg rest travel.

BACKGROUND

This section provides background information related to the present disclosure which is not necessarily prior art.

Furniture members having extensible leg rest assemblies are known. Pantograph linkage sets are commonly used providing a collapsible motion for the linkage such that the leg rest can be positioned between a fully retracted and a fully extended position inclusive.

When the leg rest assembly is returning from the fully extended toward the fully retracted position, an object can be encountered by the leg rest member or the pantograph linkage set. If the leg rest member is held in the extended position with the aid of a ratchet and pawl assembly, the return to the fully retracted position can be rapid. If the mechanism that operates the leg rest assembly includes a powered actuator such as an electric motor, the occupant of the furniture member may not be aware of the encountered object and the mechanism can continue to apply downward pressure by the leg rest assembly even after encountering the object.

SUMMARY

This section provides a general summary of the disclosure, and is not a comprehensive disclosure of its full scope or all of its features.

According to several embodiments, a release system for a furniture member leg rest assembly extended from an actuation mechanism includes an actuation mechanism, the actuation mechanism having a leg rest assembly movable between a fully retracted and a plurality of extended positions inclusive, including a fully extended position. A pantograph link of the leg rest assembly is rotatably connected to the actuation mechanism. An extension link is rotatably connected to the actuation mechanism and moves in extension and retraction directions. A member is in contact with the extension link and in releasable contact with the pantograph link. Contact between the member and the pantograph link pushes the pantograph link outward toward the fully extended position. The member is spatially separable from the pantograph link when an object is contacted by the leg rest assembly during return from any of the extended positions toward the fully retracted position.

According to other embodiments, a release system for a furniture member leg rest assembly includes an actuation mechanism, the actuation mechanism including a leg rest assembly movable between a fully retracted and a plurality of extended positions inclusive, including a fully extended position. A pantograph link of the leg rest assembly is rotatably connected to the actuation mechanism. The pantograph link has an engagement slot. An engagement pin is connected to the actuation mechanism. The engagement pin is releasably received in the engagement slot during extension of the pantograph link and thereby the leg rest assembly when the extension link is displaced. When an obstruction item in a return path of the leg rest assembly returning toward the fully retracted position is contacted, the engagement slot permits release of the engagement pin from the engagement slot freeing the leg rest assembly to return by gravity toward the fully retracted position after removal of the obstruction item from the return path.

According to additional embodiments, a release system for a furniture member leg rest assembly extended from an actuation mechanism includes an actuation mechanism, the actuation mechanism including a leg rest assembly movable between a fully retracted and a plurality of extended positions inclusive, including a fully extended position. A pantograph link of the leg rest assembly is rotatably connected to the actuation mechanism. An extension link is rotatably connected to the actuation mechanism and moves in extension and retraction directions. A contact link is rotatably connected by a rotational fastener to the extension link. The contact link has a flange releasably contacting the pantograph link and operating to push the pantograph link outward toward the fully extended position when the extension link is moved in the extension direction. The flange of the contact link is spatially separable from the pantograph link when an object is contacted by the leg rest assembly during return from any of the extended positions toward the fully retracted position.

According to further embodiments, a release system for a furniture member leg rest assembly includes an actuation mechanism including an extendable and retractable leg rest assembly. An electrically powered drive assembly is connected to the actuation mechanism operating to move the leg rest assembly between a retracted position and any of a plurality of extended positions inclusive including a fully extended position. A pantograph link of the leg rest assembly is rotatably connected to the actuation mechanism. An extension link is rotatably connected to the actuation mechanism and moves in extension and retraction directions. A member is in contact with the extension link and is in releasable contact with the pantograph link. Contact between the member and the pantograph link pushes the pantograph link outward toward the fully extended position. The member is spatially separable from the pantograph link when an object is contacted by the leg rest assembly during return from any of the extended positions toward the fully retracted position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 14 is a top perspective view of a polymeric attachment for a release portion of the mechanism;

FIG. 15 is a rotated top perspective view of the polymeric attachment of FIG. 14;

Corresponding reference numerals indicate corresponding parts throughout the several views of the drawings.

DETAILED DESCRIPTION

Figure 1:
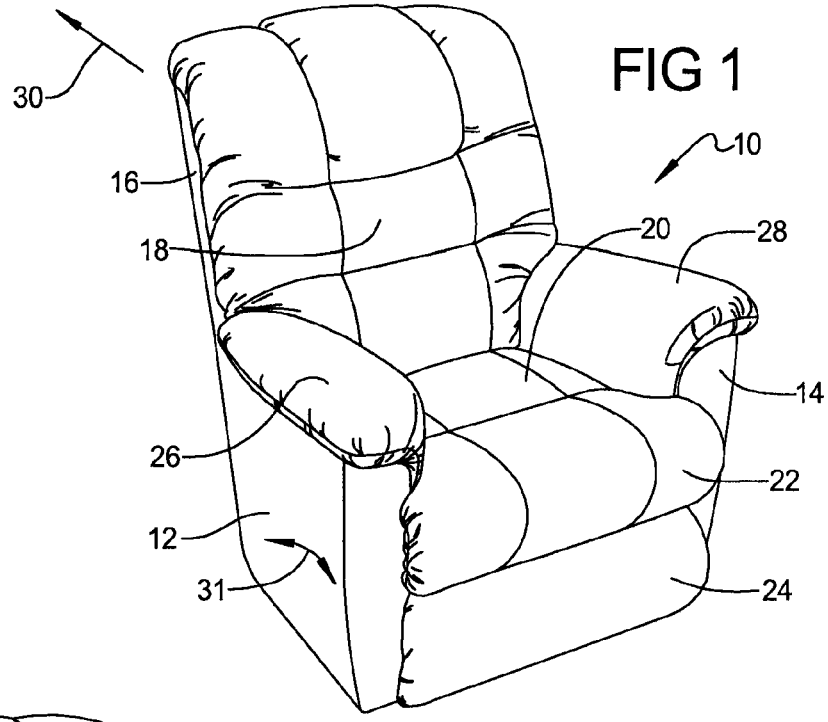
FIG. 1 is a front perspective view of a furniture member having an in-line linkage mechanism of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIG. 1, a furniture member 10 depicted as a reclining chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. An occupant's weight generally centered on support member 20 is normally operable to maintain seat back 16 in an upright position. When the leg rest assembly 24 is positioned in a stowed or retracted position shown, seat back 16 cannot be manually reclined or rotated with respect to a seat back arc of rotation 30. Seat back 16 rotates about arc of rotation 30 only after leg rest assembly 24 reaches a fully extended position shown and described with reference to FIGS. 12 and 13. Seat back 16 returns to the upright position shown and opposite to seat back arc of rotation 30 when a command is given by the occupant to return leg rest assembly 24 from a fully extended position to the fully retracted position shown.

According several embodiments, furniture member 10 can independently rotate or rock about a furniture member arc of rotation 31 by motion of the occupant and without requiring powered operation. In the embodiment shown, furniture member 10 is depicted as a chair however the present teachings are not limited to chairs. Furniture member 10 can be any of a plurality of furniture members, including, but not limited to single or multiple person furniture members, sofas, sectional members and/or loveseats.

Figure 2:
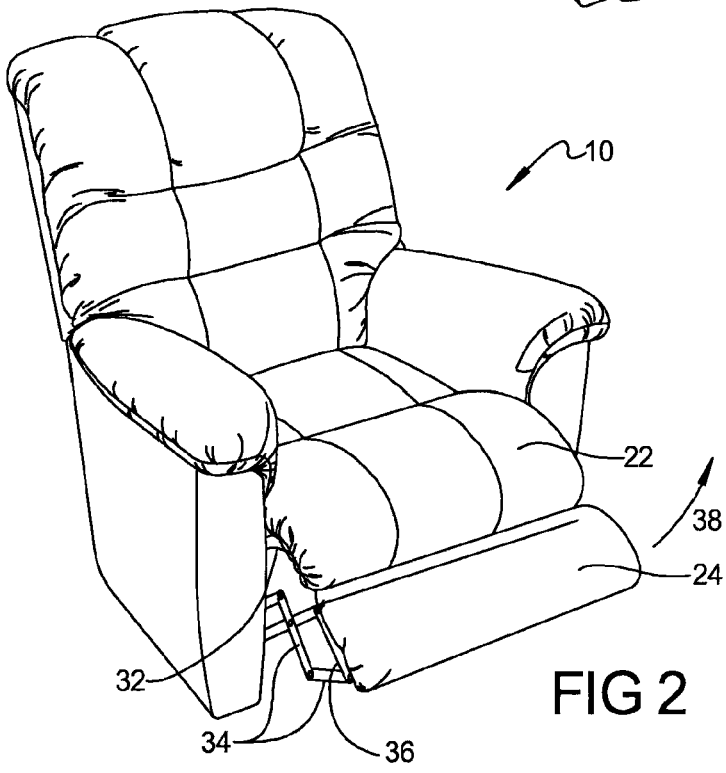
FIG. 2 is a front perspective view of the furniture member of FIG. 1 having a leg rest assembly shown in an extended position.

Referring generally to FIG. 2, an actuation mechanism 32 can be automatically actuated by command from the occupant to direct the repositioning of leg rest assembly 24 from the stowed position (shown in FIG. 1) to an extended position. Actuation mechanism 32 supports and permits both extension and retraction of leg rest assembly 24, as well as rotation of seat back 16. More specifically, actuation mechanism 32 includes first and second pantograph linkage sets 34, 35 (second pantograph linkage set 35 is not visible in this view) which are linked to leg rest assembly 24 using first and second leg rest support arms 36, 37 (only first leg rest support arm 36 is visible in this view). Leg rest assembly 24 can be moved from the fully retracted position (shown in FIG. 1) to an extended position by motion of the leg rest assembly 24 about an extension arc 38. It will be apparent that rotation of leg rest assembly 24 in an opposite direction from extension arc 38 will return the leg rest assembly 24 to the retracted position.

Figure 3:
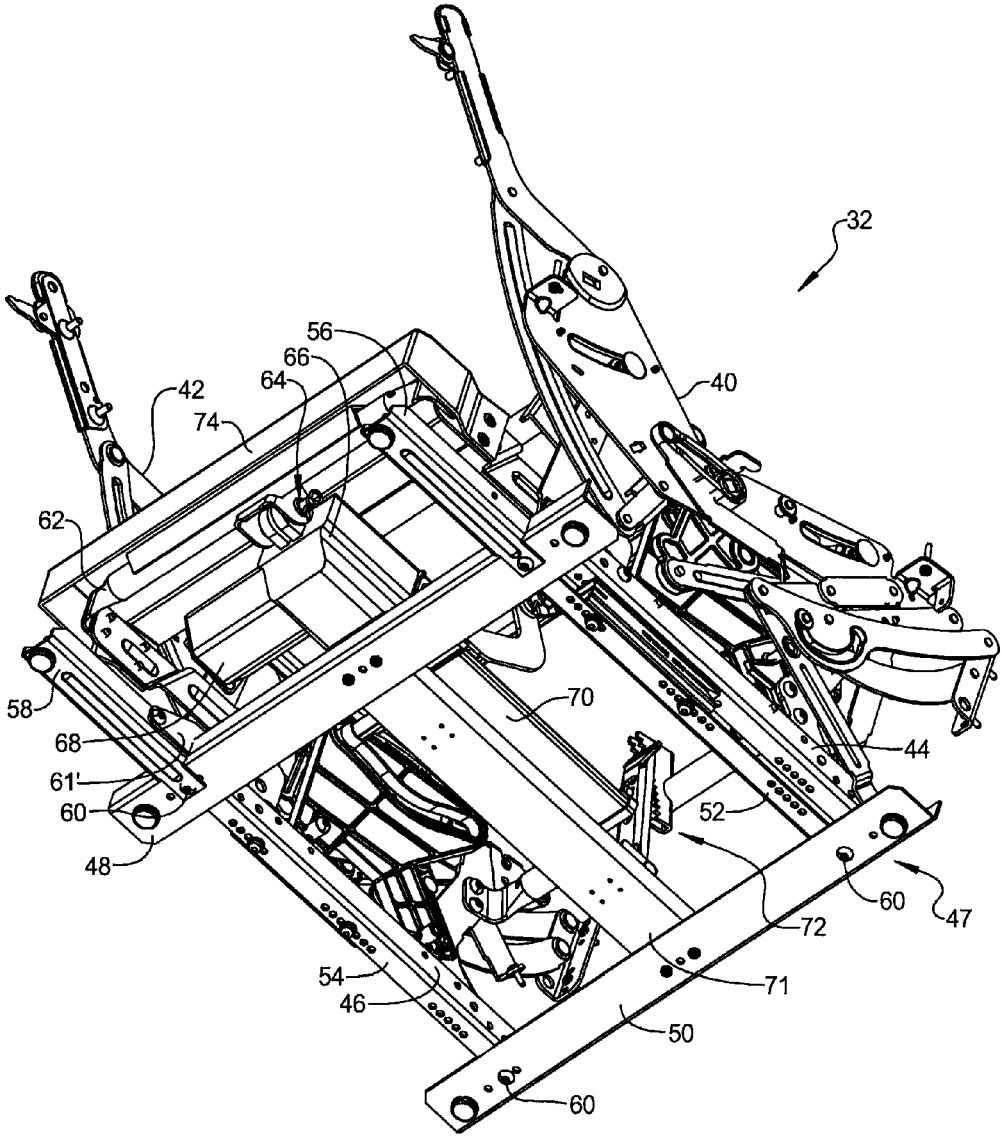
FIG. 3 is a bottom right perspective view of the mechanism of the present disclosure.

Referring to FIG. 3, the functional and structural aspects of actuation mechanism 32 for use in either single or multi-person furniture members 10 is shown. For purposes of clarity, FIG. 3 shows the various pre-assembled frame components with their upholstery, padding, etc. removed to better illustrate the interdependency of the mechanism components' construction which can be rapidly and efficiently assembled. Therefore, all of the mechanism components can be individually fabricated or sub-assembled to include the requisite brackets, springs, padding and upholstery on an "off-line" batch-type basis. Thereafter, the various pre-assembled and upholstered furniture components are assembled for totally integrating actuation mechanism 32 therein.

Actuation mechanism 32 provides multiple features which will each be separately described, including: 1) a linkage portion; 2) a motor and gear system to permit powered operation of furniture member 10; 3) a ratchet and pawl feature which retains the leg rest assembly 24 in multiple extended positions without the biasing force of spring elements; and 4) an operation control system that permits independent automatic operation of leg rest assembly 24 and seat back 16.

As generally used herein, the terms front or forward and right hand or left hand are oriented with respect to the direction an occupant of the furniture member 10 faces when seated or with respect to the occupant's sides when the occupant is seated. The terms rear or rearward refer to a direction opposite to the front or forward direction. The linkage portion of actuation mechanism 32 includes right and left side assemblies 40, 42, which are connected to and supported on right and left side support members 44, 46. Right and left side support members 44, 46 are themselves rotatably connected to a frame support structure 47 such that right and left side support members 44, 46 and right and left side assemblies 40, 42 can collectively and/or independently move with respect to frame support structure 47.

Frame support structure 47 includes multiple frame members including rear and front cross frame members 48, 50, right and left lateral frame members 52, 54, and right and left frame extensions 56, 58. Occupant loads at a front portion of furniture member 10 are transferred from right and left lateral frame members 52, 54 to front cross frame member 50 which is connected such as by threaded fasteners or rivets 60 to right and left lateral frame members 52, 54. Similarly, occupant loads at a rear portion of the furniture member 10 are transferred from right and left lateral frame members 52, 54 to rear cross frame member 48 which is connected such as by threaded fasteners or rivets 60 to right and left lateral frame members 52, 54. Right and left frame extensions 56, 58 are connected to rear cross frame member 48 by threaded fasteners or rivets 60 and by brackets 61, 61' (only left side bracket 61' is visible in this view). In some embodiments the frame members can each be created from formed, bent and/or extruded angle elements, of metal such as steel or aluminum, or of polymeric or composite materials. The present disclosure is not limited by the material used for the frame components.

A rear cross support member 62 connects right and left side support members 44, 46. A hinge pin assembly 64 connected to cross support member 62 rotatably supports an electrically powered and occupant controlled drive assembly 66. A motor 68 such as an AC or DC electric motor is connected to drive assembly 66 to provide powered operation of actuation mechanism 32 via drive assembly 66. A gear housing 70 can extend forward from drive assembly 66 and provide for a gear drive such as a worm drive gear. Drive assembly 66 and gear housing 70 are together freely rotatable above a central lateral frame member 71. Central lateral frame member 71 supports a portion of a ratchet and pawl assembly 72 which is also freely disposed with respect to gear housing 70. A cover member 74 is connected to right and left lateral frame members 52, 54 which at least partially covers hinge pin assembly 64, drive assembly 66 and motor 68.

Figure 4:
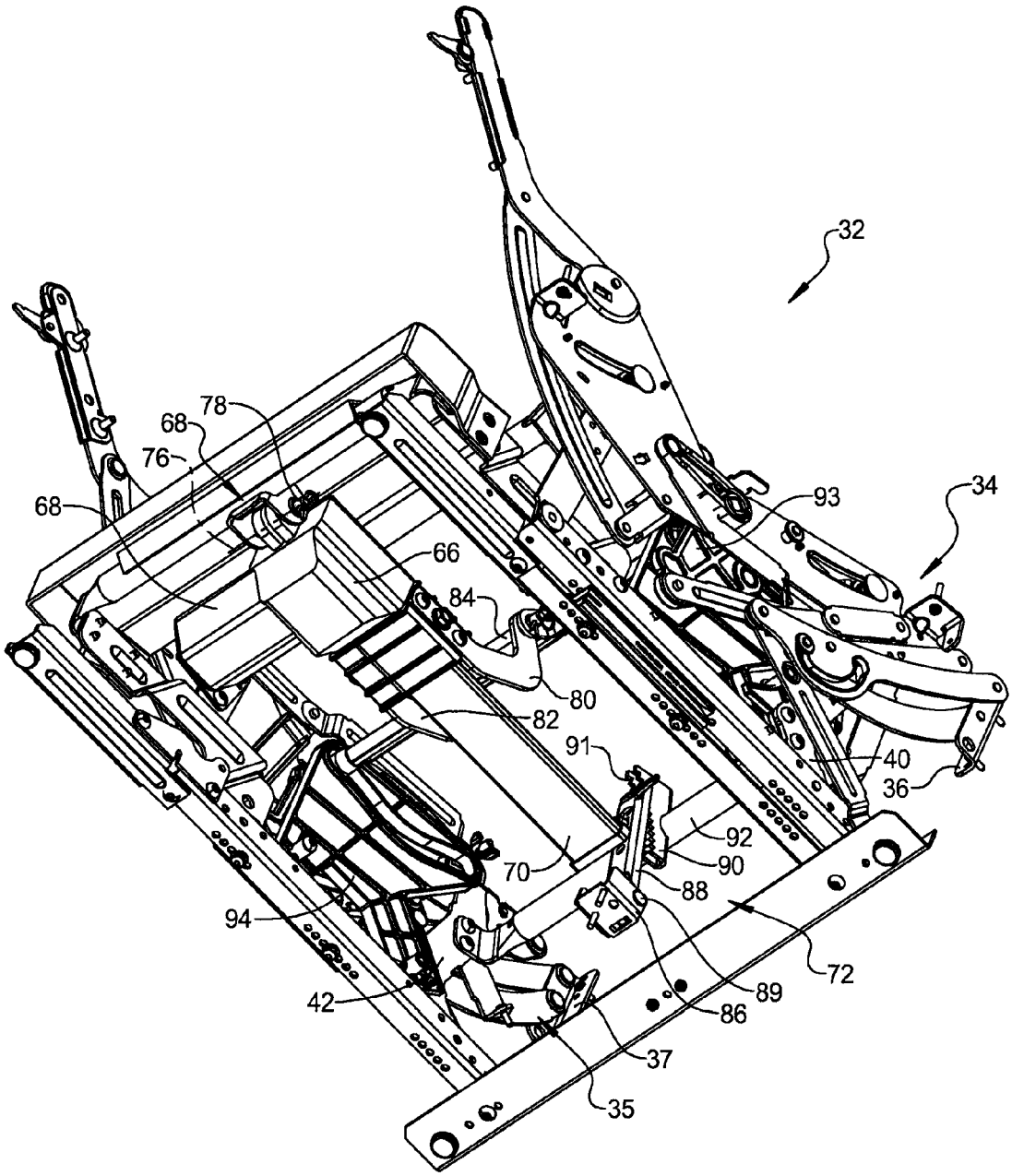
FIG. 4 is a bottom right perspective view similar to FIG. 3 further showing selected frame members removed for clarity.

Referring to FIG. 4, drive assembly 66 is rotatable about a longitudinal axis of rotation 76 defined by a hinge pin 78 rotatably received in hinge pin assembly 64. Drive assembly 66 including motor 68 and gear housing 70 rotate about longitudinal axis of rotation 76 from the position shown in FIG. 4 to an upward position or position rotated away from the viewer as viewed in FIG. 4 as the leg rest assembly 24 (only partially shown in this view as first and second leg rest support arms 36, 37) is rotated from the stowed position to an extended position. The drive assembly 66 is connected using first and second rigid drive links 80, 82 to a drive rod 84. Each of the first and second rigid drive links 80, 82 are fixedly connected to drive assembly 66.

Rocking motion of actuation mechanism 32 described with reference to FIG. 1 is precluded for any extended position of leg rest assembly 24 by engagement of ratchet and pawl assembly 72. Ratchet and pawl assembly 72 includes a pawl support bracket 86 which rotatably supports a pawl member 88 via a pivot pin 89. A ratchet 90 is fixedly connected to a front cross support member 92 fixedly connected between opposite sides of actuation mechanism 32. As leg rest assembly 24 extends, pawl member 88 engages individual teeth 91 of ratchet 90 which both prevents further rocking motion of the actuation mechanism 32 and temporarily creates a hold position of leg rest assembly 24 until a control command is given by the occupant of the furniture member to return leg rest assembly 24 from any extended position to the retracted position.

Actuation mechanism 32 further includes opposed first and second sequencing plates 93, 94, which according to several embodiments can be created such as a molding of a polymeric material such as polyoxymethylene. The material selected for first and second sequencing plates 93, 94 provides structural rigidity while also providing for reduced friction during sliding/rotating motion of drive rod 84. Material for the first and second sequencing plates 93, 94 can also be other polymeric materials or can be cast or formed from a metal material such as aluminum. First and second sequencing plates 93, 94 receive opposed ends of drive rod 84 to provide a rotational and displacement passage for drive rod 84.

Figure 5:
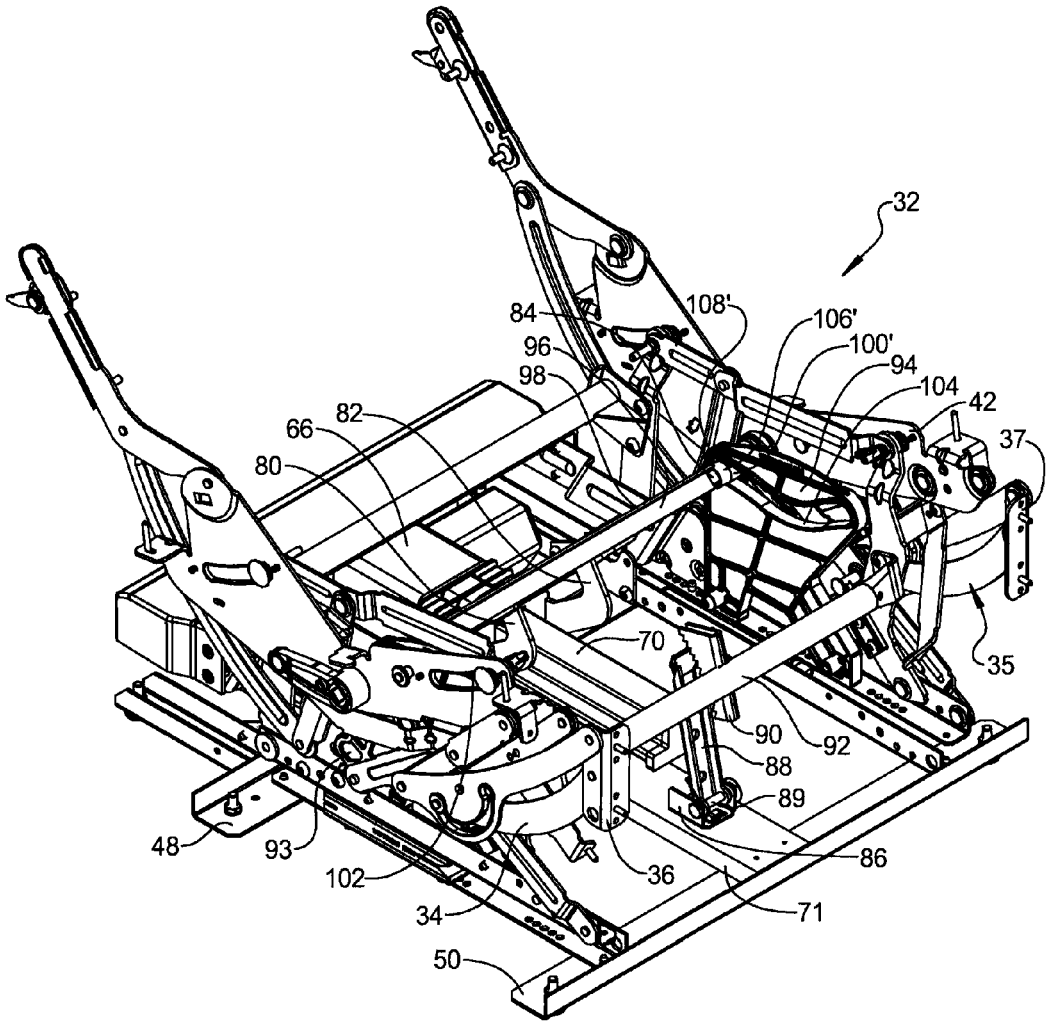
FIG. 5 is a front right perspective view of the mechanism of FIG. 3.

Referring to FIG. 5, both a rotational and a translational load is imparted to drive rod 84 by the first and second rigid drive links 80, 82, therefore drive rod 84 may be longitudinally stiffened using a reinforcing member 96 fixed, for example, by welding to drive rod 84. Reinforcing member 96 can be in the form of an L-shaped bracket having a reinforcing member leg 98. A polymeric bushing 100, 100' is attached at both opposed ends of drive rod 84. The polymeric bushings 100, 100' are individually slidably received in one of a first or second curved elongated channel 102, 104 each created in one of the first and second sequencing plates 93, 94. To align and retain the polymeric bushings 100, 100' within the first and second curved elongated channels 102, 104, a spacer member 106, 106' (spacer member 106 is not visible in this view) is positioned between each polymeric bushing 100, 100' and the reinforcing member 96. In the leg rest fully retracted position shown, each of the polymeric bushings 100, 100' and the drive rod 84 are positioned proximate to or in contact with a first channel end wall 108, 108' (first channel end wall 108 is not visible in this view) of the first and second curved elongated channels 102, 104. As clearly seen in FIG. 5, central lateral frame number 71 provides a connection location and direct support of pawl support bracket 86 and pawl member 88.

Figure 6:
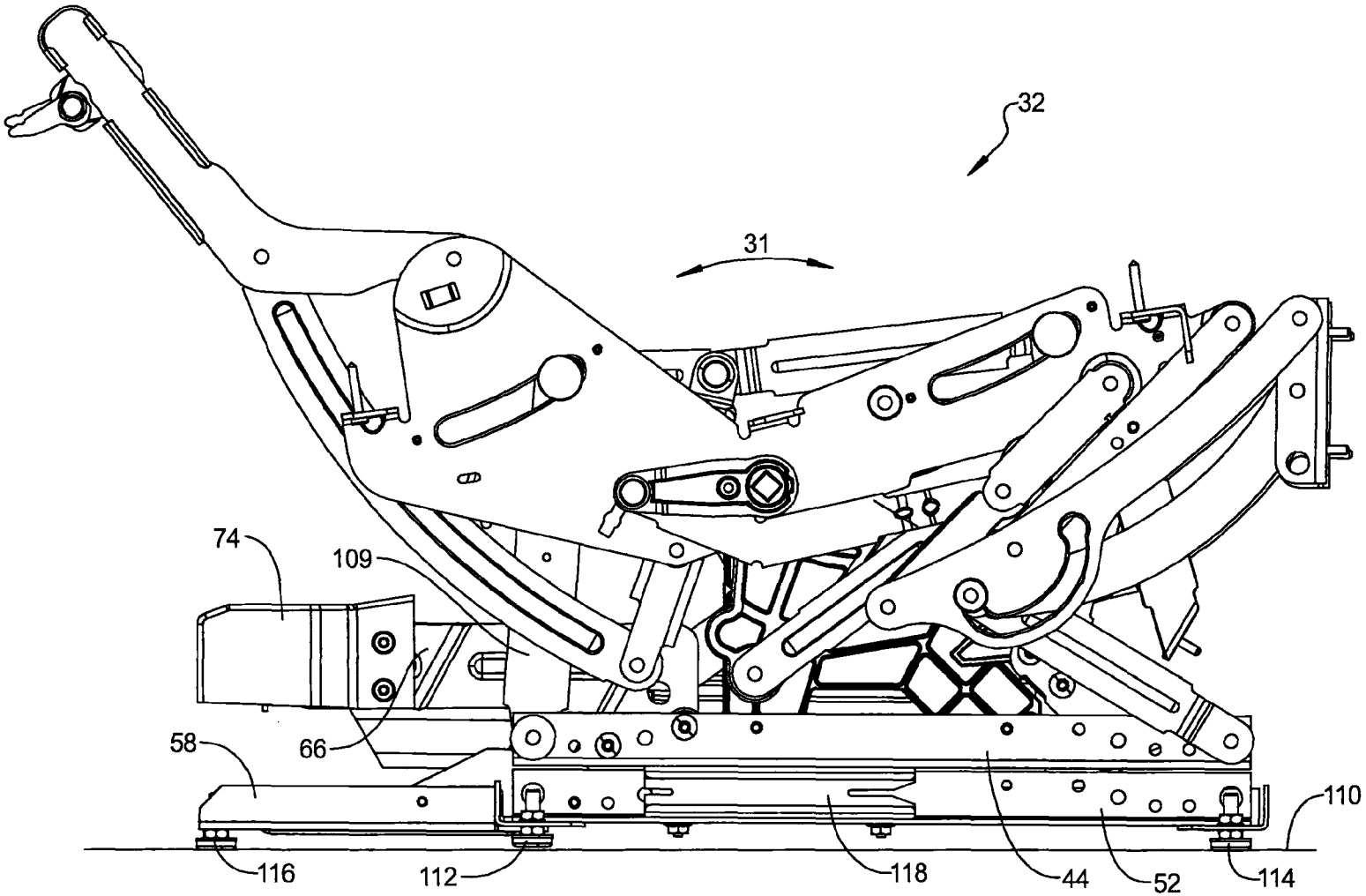
FIG. 6 is right side elevational view of the mechanism of FIG. 3.

Referring to FIG. 6, actuation mechanism 32 can be supported directly on a planar floor surface 110 using a combination of a rear adjustable height leg 112, a front adjustable height leg 114, and a frame extension adjustable height leg 116, which are each duplicated on opposite sides of the actuation mechanism 32. In order to provide for rocking motion of the actuation mechanism 32, a rocking motion biasing member 118 is connected such as by fastening between the side support members such as right side support member 44 shown and the lateral frame members such as right lateral frame member 52. Rocking motion biasing member 118 therefore provides for furniture member arc of rotation 31. As evident in FIG. 6, cover 74 extends at least partially over the rearward extension of drive assembly 66 with respect to a rear support link 109. According to several embodiments, rocking motion biasing member 118 acts as a rotation and/or biasing member for the furniture member and can be made of an elastically flexible, resilient polymeric material. According to several embodiments, rocking motion biasing member 118 is completely defined as a block shape such as a rectangle, having no coils or extending members common to coiled spring biasing members.

Figure 7:
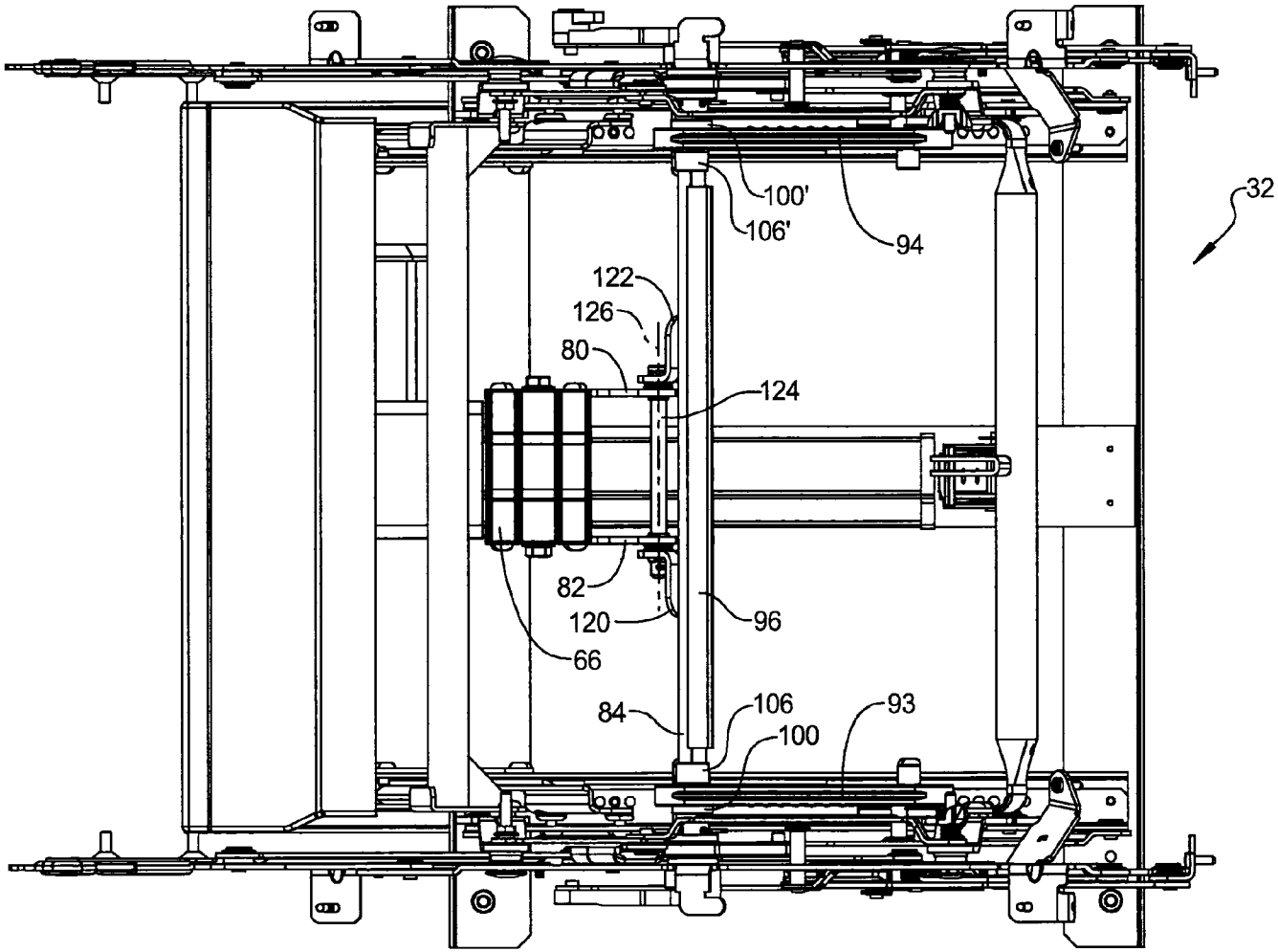
FIG. 7 is a top plan view of the mechanism of FIG. 3.

Referring to FIG. 7, as previously noted, first and second rigid drive links 80, 82 are fixedly connected to drive assembly 66. To provide for axial rotation of drive rod 84, the first and second rigid drive links 80, 82 are therefore rotationally connected to the drive rod 84 using first and second drive rod connecting links 120, 122, which are each rotatably connected to a bracket support pin 124 such that first and second drive rod connecting links 120, 122 rotate with respect to a support pin axis of rotation 126 of bracket support pin 124. Drive rod 84 can therefore axially rotate as well as translate forward and rearward in order to achieve the various extended positions and the retracted position of the leg rest assembly as well as the seat back. First and second drive rod connecting links 120, 122 are fixedly connected such as by welding or fastening to drive rod 84, therefore axial rotation of drive rod 84 is induced by the generally upward and downward rotational movement of first and second rigid drive links 80, 82 causing rotation of first and second drive rod connecting links 120, 122 with respect to bracket support pin 124.

Figure 8:
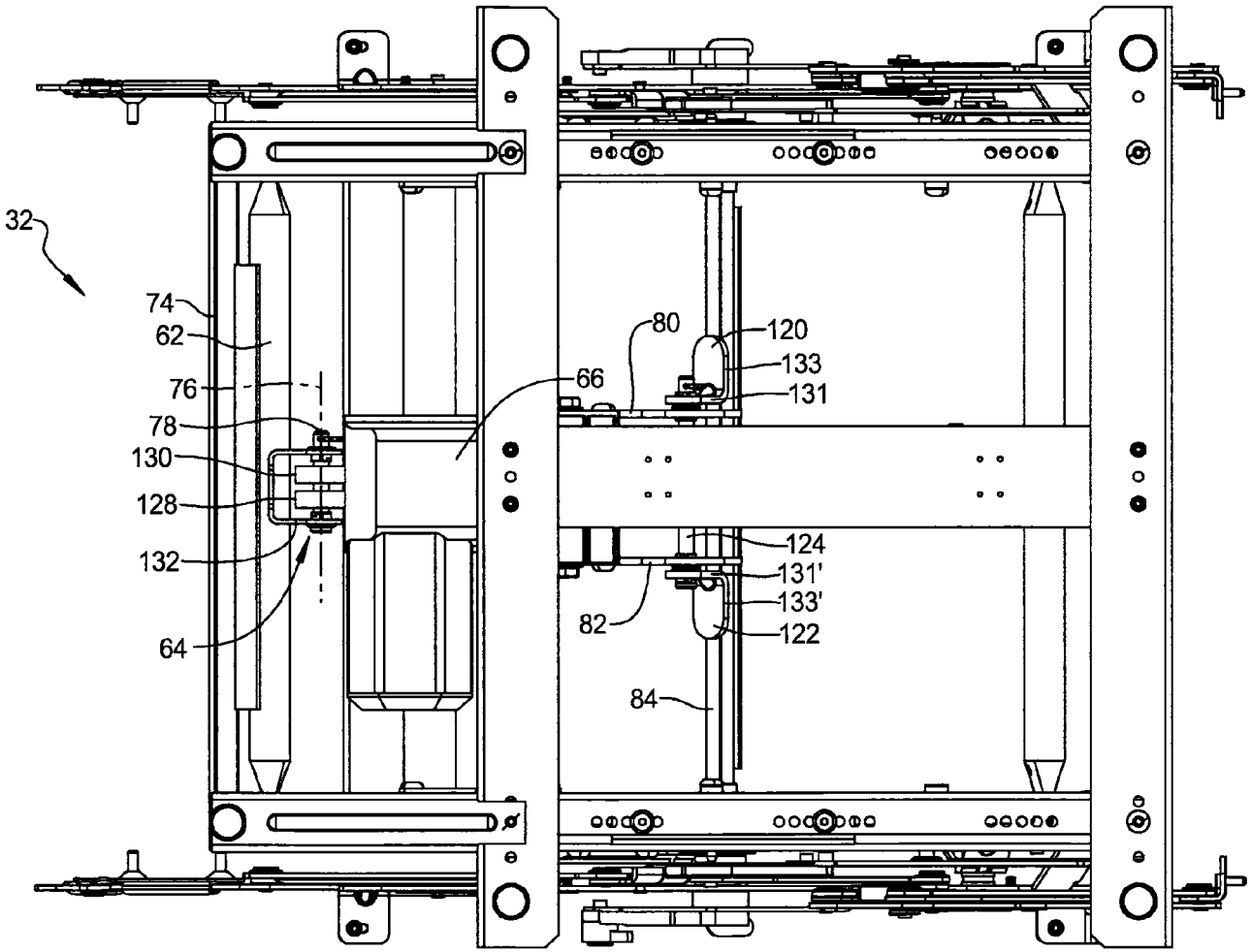
FIG. 8 is a bottom plan view of the mechanism of FIG. 3.

Referring to FIG. 8, the hinge pin assembly 64 provides for rotational connection between drive assembly 66 and rear cross support member 62. First and second support arms 128, 130 extend rearwardly from drive assembly 66, having hinge pin 78 rotatably disposed therethrough. Outward ends of hinge pin 78 are also captured by opposed bracket legs of a U-shaped bracket 132 permitting rotation about longitudinal axis of rotation 76. As more clearly evident in this view, the first and second drive rod connecting links 120, 122 can be formed as L-shaped members each having a first leg 131, 131' and a second leg 133, 133'. Bracket support pin 124 is rotatably received through the first legs 131, 131'.

Figure 9:
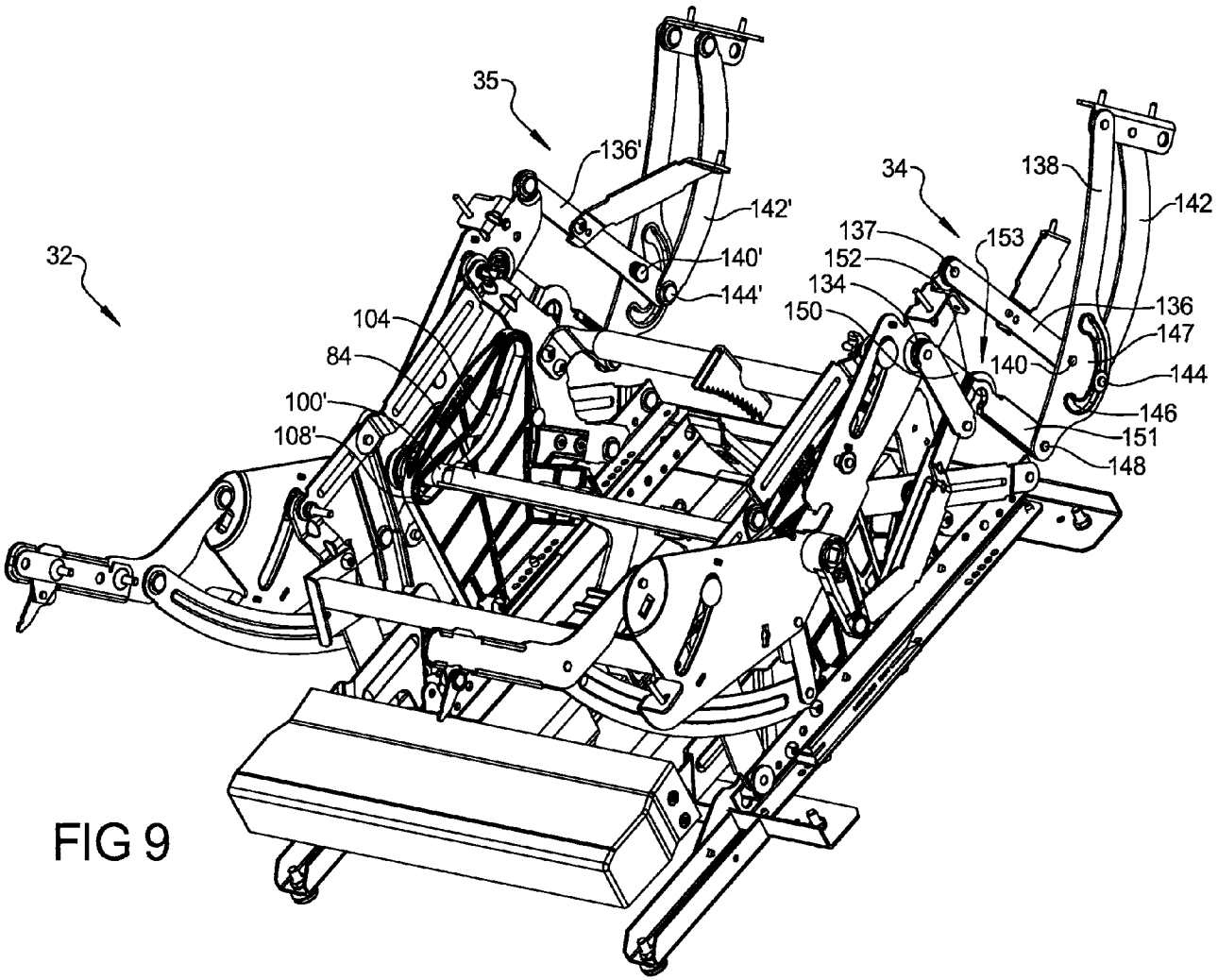
FIG. 9 is a rear right perspective view of the mechanism in a partially extended leg rest release position.

Referring to FIG. 9, each of the first and second pantograph linkage sets 34, 35 are shown in a release position which can occur as the first and second pantograph linkage sets 34, 35 are returning from an extended position toward the retracted position if contact is made by one or both of the first and second pantograph linkage sets 34, 34 or the leg rest assembly 24 (not shown in this view) with an object under the pantograph linkage sets or leg rest assembly 24. In the example shown in FIG. 9, drive rod 84 is moving rearwardly within first and second elongated channels 102, 104 and has nearly reached the first channel end wall 108, 108' which would normally establish the fully retracted position of the leg rest assembly.

Each of the first and second pantograph linkage sets 34, 35 are similarly constructed, therefore the following description of first pantograph linkage set 34 is equally applicable to second pantograph linkage set 35. A mechanism side plate 134 has a first pantograph link 136 rotatably connected to the mechanism side plate 134 using a pin 137. A leg rest support link 138 is rotatably connected to first pantograph link 136 using a pin 140. A leg rest angle control link 142 is also rotatably connected to first pantograph link 136 using a multiple connection pin 144. Multiple connection pin 144 is slidably disposed within an elongated U-shaped slot 146 created in an extended width portion 147 of leg rest support link 138. A pin 148 rotatably connects an end of leg rest support link 138 to a second pantograph link 150. A polymeric attachment 151 is attached to second pantograph link 150 which will be shown and described in greater detail in reference to FIGS. 14 and 15. An engagement slot 152 is provided in polymeric attachment 151 to permit release of the first pantograph linkage set 34 upon contact with an object during retraction of the pantograph linkage set 34, defining a leg rest release system 153.

Figure 10:
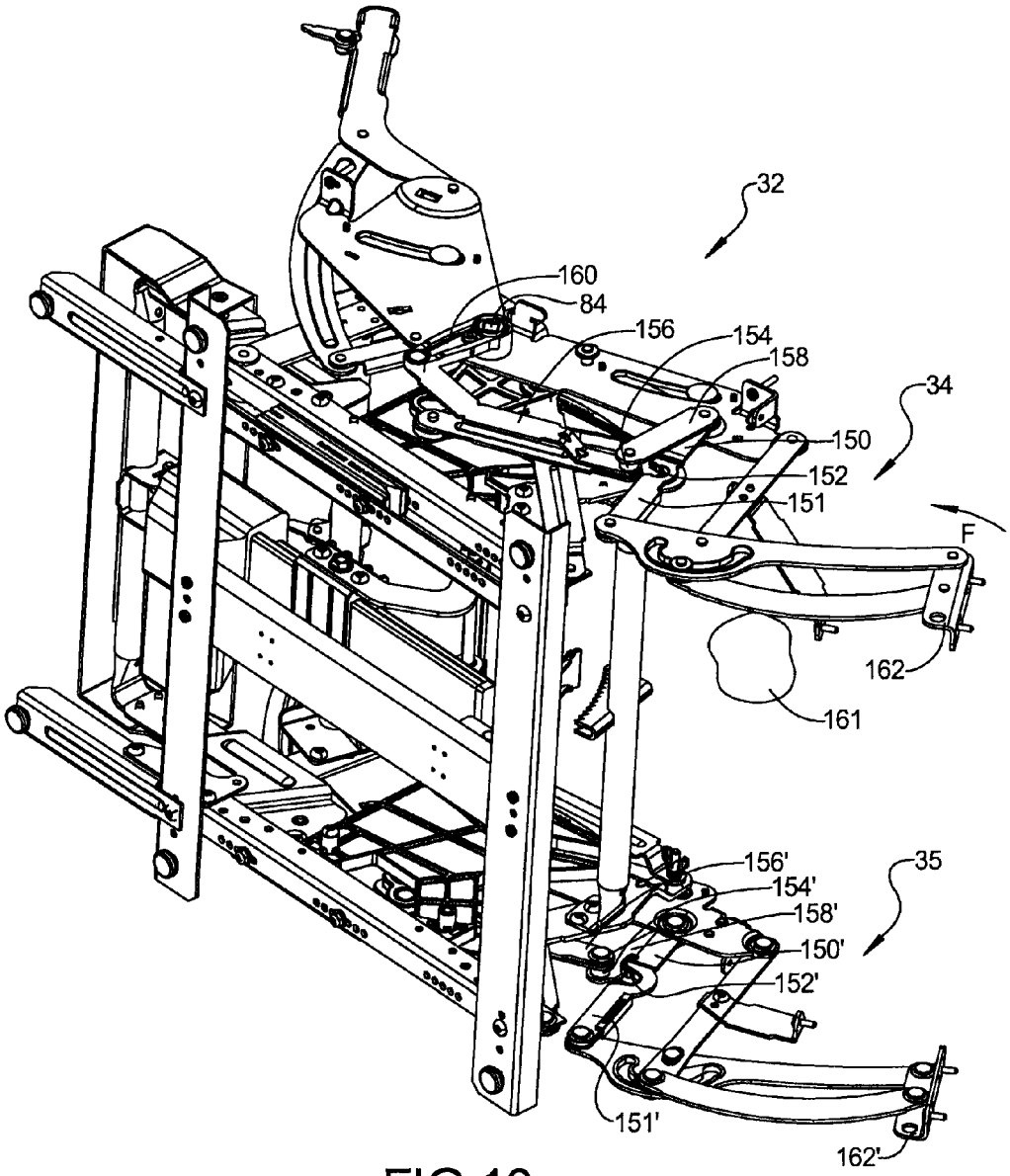
FIG. 10 is a bottom right perspective view of the mechanism of FIG. 9.

Referring to FIG. 10, release system 153 operates as follows. Engagement slot 152 normally receives and releasably captures an engagement pin 154, which is connected at a free end of an extension link 156. Engagement pin 154 is also rotatably connected at a free end of a carrier link 158. Engagement pin 154, when seated within engagement slot 152, permits normal extension and retraction of each of the first and second pantograph linkage sets 34, 35. When the engagement pin 154 releases out of (or freely away from) the engagement slot 152, the pantograph linkage set is thereafter freely rotatable with respect to extension link 156, which continues to be rotatably retracted to the leg rest retracted position by rotatable connection to a leg rest lock link 160. Leg rest lock link 160 is fixed to a free end of drive rod 84 such that rotation of drive rod 84 co-rotates the leg rest lock link 160. An orientation of engagement slot 152 is provided having an opening into the engagement slot facing rearward allowing extension link 156 to continue in powered motion in a rearward direction if engagement pin 154 is released from the engagement slot 152, for example if a portion of either or both first and pantograph linkage sets 34 and/or 35 encounters an object or obstruction item 161 during return travel from an extended position toward the fully reclined position. When engagement pin 154 is disengaged from engagement slot 152, the pantograph linkage set 34 can either remain at its position due to object or obstruction item 161 it has contacted or is thereafter free to gravity rotate toward the leg rest retracted position when the obstruction item is removed from under the pantograph linkage set. A force "F" applied to the leg rest assembly 24 through leg rest connection brackets 162, 162' (for example by the occupant) is thereafter required to reset engagement pin 154 into engagement with engagement slot 152, which will be described in further detail in reference to FIGS. 14 and 15. Carrier link 158 maintains a repeatable position of engagement pin 154 to permit re-engagement of engagement pin 154 within engagement slot 152.

Figure 11:
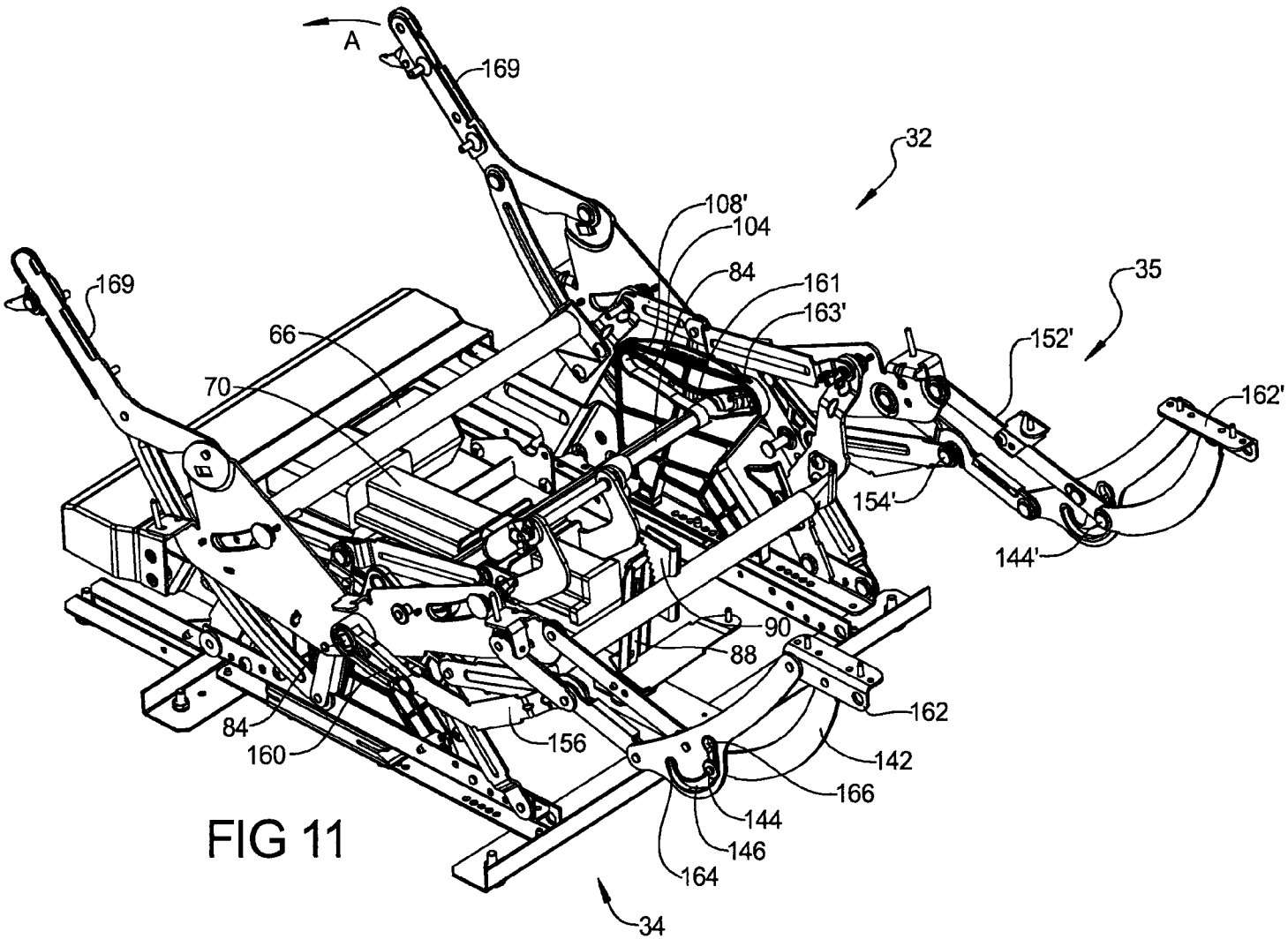
FIG. 11 is a top right perspective view of the mechanism in a leg rest fully extended position.

Referring to FIG. 11, a fully extended position of leg rest assembly 24 and first and second pantograph linkage sets 34, 35 is provided when drive rod 84 reaches a lowest elevation slot position 161 of first and second curved elongated channels 102, 104 (first curved elongated channel 102 is not clearly visible in this view). In the fully extended position, the multiple connection pin 144 is positioned furthest away from a first slot end wall 164 of the U-shaped slot 146 and closest to a second slot end wall 166 of the U-shaped slot 146. This positioning of multiple connection pin 144 extends leg rest angle control link 142 to a furthest forward position which fully rotates the first and second leg rest support arms 36, 37 and first and second leg rest connection brackets 162, 162'. The fully extended position of leg rest assembly 24 is reached when drive rod 84 fully rotates leg rest lock link 160 in a forward directed rotation which fully extends extension link 156 in a forward direction. Also in the fully extended position, engagement pin 154 is fully engaged within engagement slot 152 and maintained fully engaged by gravity plus the weight of the occupant's legs on leg rest assembly 24.

During extension of the leg rest assembly 24 from the retracted to the fully extended position, right and left seat back support members 168, 169 are maintained in a seat back upright orientation. Once the fully extended position of leg rest assembly 24 is reached, further rotation of drive assembly 66 and gear housing 70 no longer functions to axially rotate the drive rod 84, but instead forwardly translates drive rod 84 within first and second curved elongated channels 102, 104 from the lowest elevation slot position 161 until drive rod 84 is positioned proximate to or contacts a second channel end wall 163, 163' (second channel end wall 163 is not clearly visible in this view). Translation motion of drive rod 84 from the lowest elevation slot position 161 until positioned proximate to or in contact with second channel end wall 163, 163' generates a continuous rearward rotation of right and left seat back support members 168, 169 in a seat back arc of rotation "A".

To return from the fully extended position of leg rest assembly 24 to the fully retracted position, actuation mechanism 32 is operated in an opposite manner. Initially, with drive rod 84 in contact with second channel end wall 163, 163' downward rotation of drive assembly 66 and gear housing 70 results in translation in a rearward direction of drive rod 84 until drive rod 84 once again reaches the lowest elevation slot position 161. From this position, combined axial rotation and rearward translation of drive rod 84 again occurs from further downward rotation of drive assembly 66 and gear housing 70 which rotates leg rest lock links 160, 160' pulling extension links 156, 156' rearward and returning the pantograph linkage sets 34, 35 toward the retracted position. It is further noted that downward rotation of gear housing 70 after the leg rest fully extended position is reached causes disengagement of the pawl member 88 from ratchet 90 which permits rotation of the pantograph linkage sets 34, 35. It is also noted that first and second curved elongated channels 102, 104 define a generally V-shape configuration having the lowest elevation slot position 161 downwardly positioned with respect to each of the first channel end wall 108 and second channel end wall 163 positions.

Figure 12:
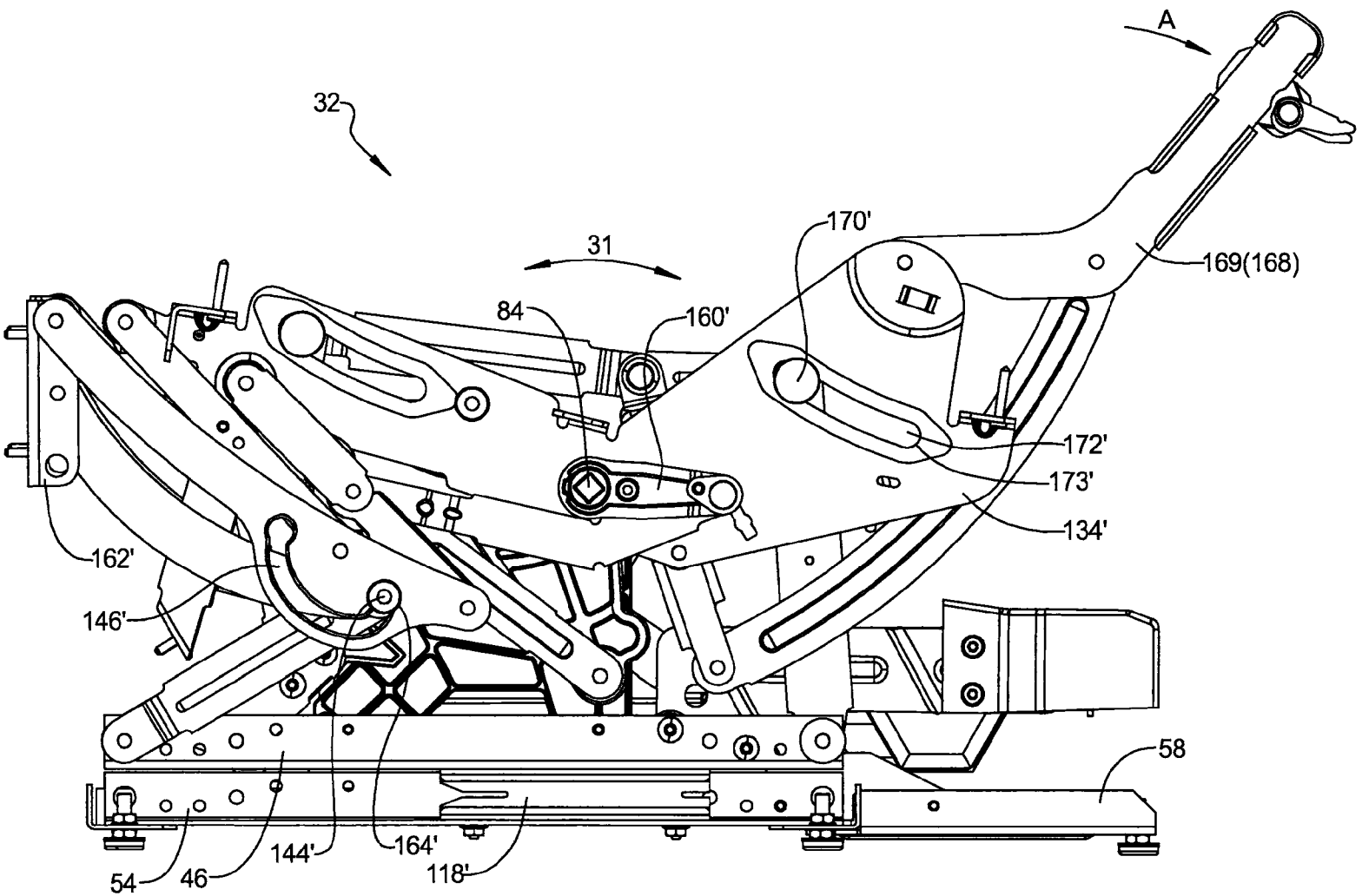
FIG. 12 is a left side elevational view of the mechanism in a leg rest fully retracted position.

Referring to FIG. 12, the fully retracted position of leg rest assembly 24 shown permits rocking motion of actuation mechanism 32 about furniture member arc of rotation 31. Right and left seat back support members 168, 169 (only left seat back support member 169 is visible in this view) are positioned in the seat back upright position and can move in the seat back arc of rotation "A" during powered actuation by sliding movement of a seat back motion pin 170, 170' within an elongated slot 172, 172' (seat back motion pin 170 and elongated slot 172 are not clearly visible in this view). Contact between the seat back motion pin 170' with a slot end wall 173 defines the fully rotated seat back position. As previously noted, positioning rocking motion biasing member 118' between left side support member 46 and left lateral frame member 54 permits rocking motion with respect to furniture member arc of rotation 31 of the components of actuation mechanism 32 which are positioned above left side support member 46. Occupant induced (non-powered) rocking motion of actuation mechanism 32 is permitted at least when leg rest assembly 24 is positioned in the fully retracted position and the right and left seat back support members 168, 169 are positioned in the seat back fully upright position shown, or after disengagement of pawl member 88 from ratchet 90 (shown and described with reference to FIG. 11) but before leg rest assembly 24 has completely returned to its fully retracted position. Frame extensions, such as left frame extension 58, provide additional support of actuation mechanism 32 for rearward rotation during rocking motion.

Figure 13:
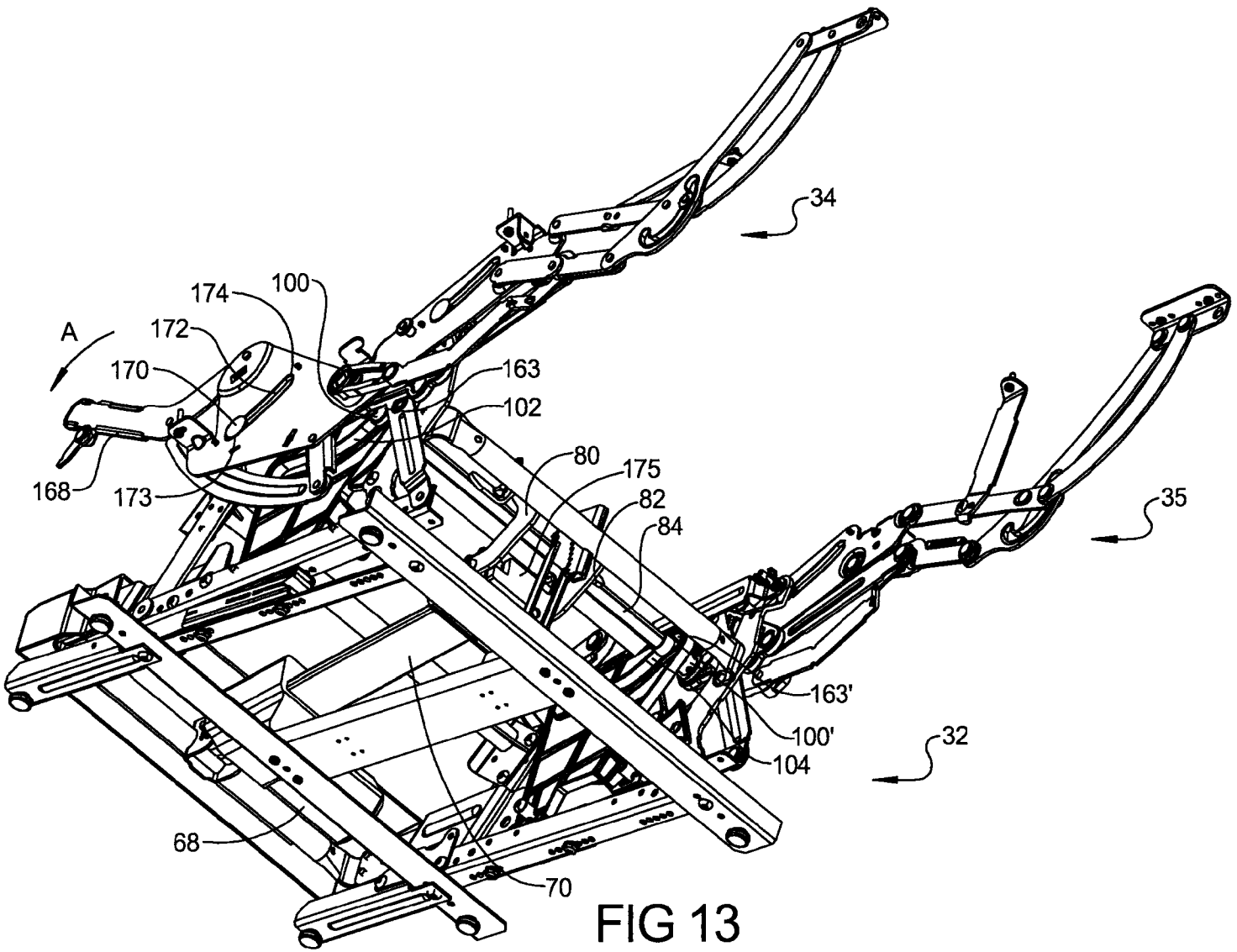
FIG. 13 is a bottom right perspective view of the mechanism in a leg rest fully extended and seat back fully reclined positions.

Referring to FIG. 13, actuation mechanism 32 is shown with leg rest assembly 24 in the fully extended position and right and left seat back support members 168, 169 rotated to the seat back fully rotated position achieved by rotation through seat back arc of rotation "A". Seat back motion pin 170 has translated away from contact with a second slot end wall 174 of elongated slot 172 and contacts slot end wall 173 in the seat back fully rotated position. Also in the seat back fully rotated position, the polymeric bushings 100, 100' contact the second channel end walls 163, 163' of each of the first and second curved elongated channels 102, 104. As most clearly seen in this view, both first and second rigid drive links 80, 82 are fixedly (such as by fastening) connected to a carriage assembly 175 which is longitudinally translated along and guided by gear housing 70 during operation of motor 68. Carriage assembly 175 reaches its fullest forward extension along gear housing 70 when the right and left seat back support members 168, 169 reach the seat back fully rotated position.

Referring to FIG. 14 and again to FIGS. 9 and 10, polymeric attachment 151 includes an attachment body 176 having an extending wall 178 transversely oriented with respect thereto. A wall inner face 180 created within extending wall 178 is semi-spherically shaped. A first contact flange 182 extends beyond the extending wall 178 at one free end of polymeric attachment 151. Proximate to a second free end of polymeric attachment 151 is positioned a second extending wall 184, which is homogeneously connected to and extends from a first edge 186 of attachment body 176. A second contact flange 188 extending in a similar direction as first contact flange 182 is oriented substantially parallel to attachment body 176. An abutment face 190 is created between attachment body 176 and a lower face 192 of second contact flange 188. A spacing "D" between lower face 192 of second contact flange 188 and a body face 194 of attachment body 176 is selected to provide a sliding fit to allow second pantograph link 150, 150' shown and described in reference to FIG. 9 to be received therebetween. Extending wall 178 is sized to be slidably received within a corresponding slot of second pantograph link 150, 150' to position engagement slot 152, 152'. With further reference to FIG. 10, polymeric attachments 151, 151' are releasably connectable to second pantograph links 150, 150' through frictional contact only, and contact at first and second contact flanges 182, 188 and do not rely on fasteners or adhesives for retention.

Referring to FIG. 15 and again to FIGS. 9, 10 and 14, polymeric attachment 151, 151' further includes a first raised shoulder 196 and an opposed second raised shoulder 198, which extend into engagement slot 152. A clearance span 200 is defined between the apexes of both first and second raised shoulders 196, 198 defining a span width "C" which is less than a diameter "B" defined by wall inner face 180 of engagement slot 152. Clearance span 200 is therefore provided to resist displacement of engagement pin 154, 154' after engagement pin 154, 154' is fully received past first and second shoulders 196, 198 within engagement slot 152, 152'. First and second raised shoulders 196, 198 are therefore created at a position in wall inner face 180 such that wall inner face 180 defines a semi-spherical geometry having an arc of rotation greater than 180°. To permit frictional passage of engagement pins 154, 154' through clearance span 200 which requires limited elastic deflection of first and second raised shoulders 196, 198, and free rotational clearance with respect to wall inner face 180 for subsequent free rotation of engagement pins 154, 154', a material of polymeric attachment 151 can be a polyamide material, but is not limited to a polyamide material. Polymeric attachment 151, 151' can also include a clearance opening 202 as required for clearance of pin 148 shown and described with reference to FIG. 9. A second abutment face 204 is also created with first contact flange 182 which is oppositely directed with respect to abutment face 190. Abutment face 190 and oppositely facing second abutment face 204 are spaced to allow side-to-side clearance with second pantograph link 150, 150'.

Referring again to FIGS. 1, 2, 6, 9, 10, 14 and 15, rocking furniture member 10 of the present disclosure therefore includes an actuation mechanism 32 including an extendable and retractable leg rest assembly 24. An electrically powered and occupant controlled drive assembly 66 connected to the actuation mechanism 32 operates upon receipt of a command from an occupant of the furniture member 10 to move the leg rest assembly 24 between a retracted position (shown in FIGS. 1 and 3 and any of a plurality of extended positions shown in FIGS. 2 and 9 inclusive including a fully extended position (shown in FIG. 11.

A pantograph link 150 of the leg rest assembly 24 is rotatably connected to the actuation mechanism 32. The pantograph link 150 has an engagement slot 152. An engagement pin 154 is connected to an extension link 156. The engagement pin 154 is releasably received in the engagement slot 152 during powered extension and retraction of the leg rest assembly 24. When an obstruction item 161 is contacted in a return path of the leg rest assembly 24 moving toward the retracted position, the engagement pin 154 is released from the engagement slot 152 allowing the leg rest assembly 24 to return by gravity toward the retracted position after removal of the obstruction item 161 from the return path.

Figure 16:
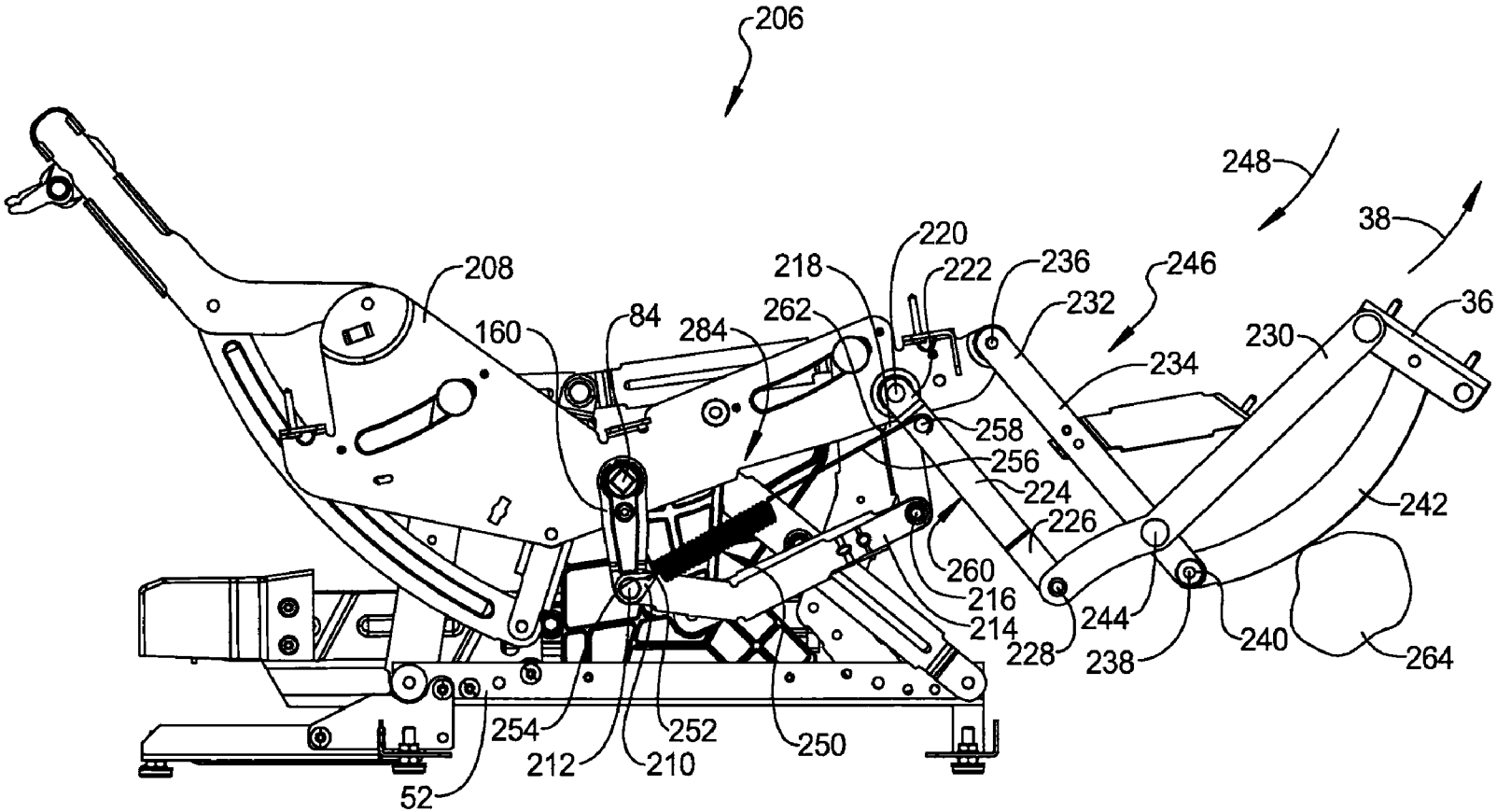
FIG. 16 is a side elevational view of a wall proximity actuation mechanism including a biasing member providing another embodiment of a release system for a leg rest assembly.

Referring to FIG. 16, an actuation mechanism 206 includes many of the components of actuation mechanism 32 previously described herein, but is modified from actuation mechanism 32 to include an alternate embodiment for releasing a leg rest assembly if the leg rest assembly encounters an object during retraction motion. Actuation mechanism 206 is rotatably connected to right lateral frame member 52 and includes a right side assembly 208. The left side assembly is substantially a mirror image of right side assembly 208 therefore the left side assembly will not be further described herein. Drive rod 84 extends through right side assembly 208 to be engaged with the leg rest lock link 160. A rotatable coupler 210 is rotatably connected to a free end of leg rest lock link 160 using a rotational fastener 212 such as a spin rivet. An extension link 214 is also rotatably connected to the free end of leg rest lock link 160 using rotational fastener 212. At an opposite end of extension link 214 from rotational fastener 212, a rotational fastener 216 is used to rotatably couple to a leg rest contact link 218. Leg rest contact link 218 is rotatably coupled to right side assembly 208 using a rotational fastener 220 received through a first end 222 of a first pantograph connecting link 224 as well as through leg rest contact link 218. A second end 226 of first pantograph connecting link 224 is rotatably coupled using a rotational fastener 228 to a first pantograph extension link 230.

A first end 232 of a second pantograph connecting link 234 is rotatably connected to right side assembly 208 using a rotational fastener 236. A second end 238 of second pantograph connecting link 234 is rotatably connected using a rotational fastener 240 to a second pantograph extension link 242. Second pantograph extension link 242 is rotatably coupled to first leg rest support arm 36. Also, second pantograph connecting link 234 is rotatably connected to first pantograph extension link 230 using a rotational fastener 244 rotationally received proximate to second end 238 of second pantograph connecting link 234.

Each of the first and second pantograph connecting links 224, 234, and first and second pantograph extension links 230, 242, as well as first leg rest support arm 36 together comprise a leg rest assembly 246. Leg rest assembly 246 is extendable in the extension arc 38 and retractable in a leg rest retraction path 248.

A biasing member 250 is connected at a first hook end 252 through an aperture 254 created in rotatable coupler 210. A second hook end 256 of biasing member 250 is hooked at least partially onto a shoulder fastener 258, which is connected to first pantograph connecting link 224. Biasing member 250 can be a spring, such as a tension spring, normally biasing leg rest assembly 246 toward a fully retracted position. During normal extension and retraction of leg rest assembly 246, a link edge 260 of first pantograph connecting link 224 contacts a flange 262 of leg rest contact link 218. This contact of link edge 260 to flange 262 supports leg rest assembly 246 for extension when drive rod 84 is rotated, (for example, in a counter -clockwise direction as shown in FIG. 16) co-rotating leg rest lock link 160. This rotation of leg rest lock link 160 extends extension link 214 to the right as shown in FIG. 16, which causes rotation of leg rest contact link 218 and thereby rotates first pantograph connecting link 224. The rotational connection of rotational fastener 224 provides the remaining force necessary to rotate second pantograph connecting link 234, and each of first and second pantograph extension links 230, 242. Link edge 260 will normally remain in abutment contact with flange 262 of leg rest contact link 218 during motion in the leg rest retraction path 248 due to the biasing force induced by biasing member 250 which is at least partially extended (inducing a biasing force tending to return leg rest assembly 246 toward its retracted position) throughout the range of leg rest assembly extended positions.

The release feature of actuation mechanism 206 works as follows. If any of the members of leg rest assembly 246 contact an object 264 (for example, object 264 is shown in contact with second pantograph extension link 242) during travel in the leg rest retraction path 248, because of continued rotation of drive rod 84 and retraction of extension link 214, link edge 260 of first pantograph connecting link 224 will spatially separate from flange 262 of leg rest contact link 218. This separation permits continued return of the extension link 214 in the direction tending to return leg rest assembly 246 in the leg rest retraction path 248 while minimizing the force of leg rest assembly 246 applied to object 264. The biasing force of biasing member 250 will retain the leg rest assembly 246 in contact with object 264; however, the biasing force of biasing member 250 is pre-determined to minimize the force applied to object 264. Once object 264 has been removed from contact with any of the members of leg rest assembly 246, the biasing force of biasing member 250 will return leg rest assembly 246 in the leg rest retraction path 248 until link edge 260 of first pantograph connecting link 224 once again contacts and abuts against flange 262 of leg rest contact link 218. Biasing member 250 thereafter provides the necessary force to hold leg rest assembly 246 in the fully retracted position after object 264 has been removed.

Rotatable coupler 210 is rotatably coupled to leg rest lock link 160 using rotational fastener 212, therefore extension link 214 can be returned to the leg rest fully retracted position by a clockwise rotation of drive rod 84 (as viewed in FIG. 16) during normal extension and retraction motions, as well as when leg rest assembly 246 contacts object 264. Biasing member 250, first pantograph connecting link 224, and leg rest contact link 218 therefore provide components of a release system 284 for leg rest assembly 246.

Figure 17:
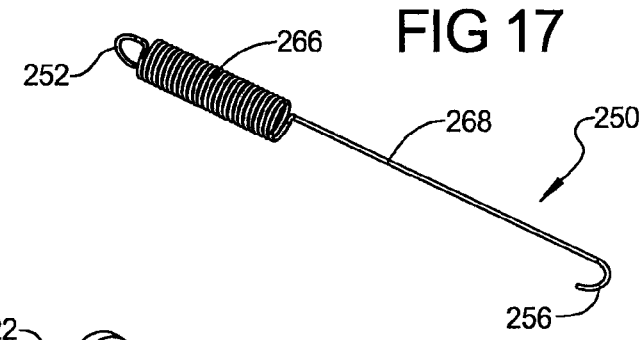
FIG. 17 is a front perspective view of the biasing member for the release system of FIG. 16.

Referring to FIG. 17, proximate to first hook end 252 of biasing member 250 can be a coiled end 266 which can include multiple substantially circular coiled legs of biasing member 250 having a quantity of coils predetermined by the amount of biasing force intended for biasing member 250. A longitudinal leg 268 extends from coil end 266 to second hook end 256. A length of longitudinal leg 268 will therefore depend on the number of coils of coil end 266 which determine in part the biasing force created by biasing member 250.

Figure 18:
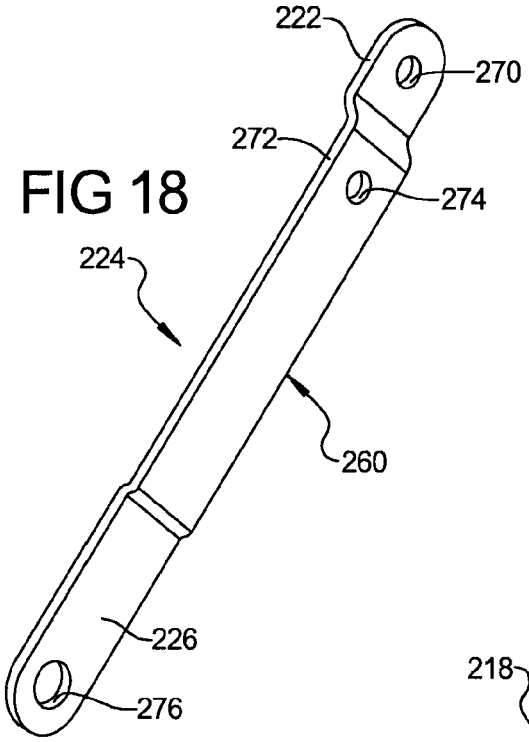
FIG. 18 is a top perspective view of a biasing member engagement link of the release system of FIG. 16.

Referring to FIG. 18 and again to FIG. 16, first pantograph connecting link 224 includes a first fastener aperture 270 created in first end 224 which is adapted to receive rotational fastener 220. A raised portion 272 can be created between first and second ends 222, 226 which provide clearance for rotational movement of first pantograph connecting link 224 with respect to extension link 214 and rotational fastener 216. A second fastener aperture 274 is created in raised portion 272 proximate to first end 222 which is adapted to rotatably receive shoulder fastener 258. A third fastener aperture 276 created in second end 226 is adapted to rotatably receive rotational fastener 228.

Figure 19:
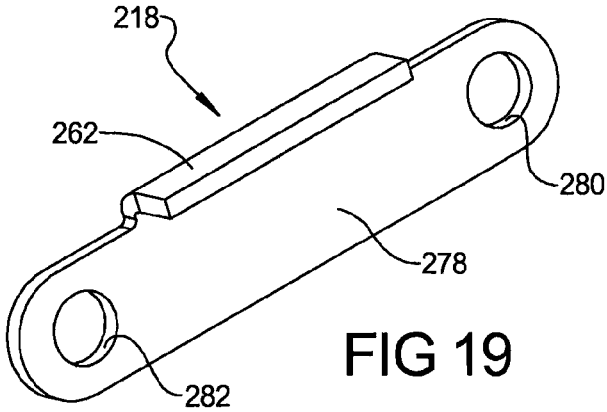
FIG. 19 is a front perspective view of a leg rest assembly push link of the release system of FIG. 16.

Referring to FIG. 19 and again to FIG. 16, leg rest contact link 218 includes a planar link body 278 having flange 262 oriented and extending substantially perpendicular with respect to planar link body 278. First and second fastener apertures 280, 282 are created at opposite ends of planar link body 278. First fastener aperture 280 rotatably receives rotational fastener 220. Second fastener aperture 282 rotatably receives rotational fastener 216.

Figure 20:
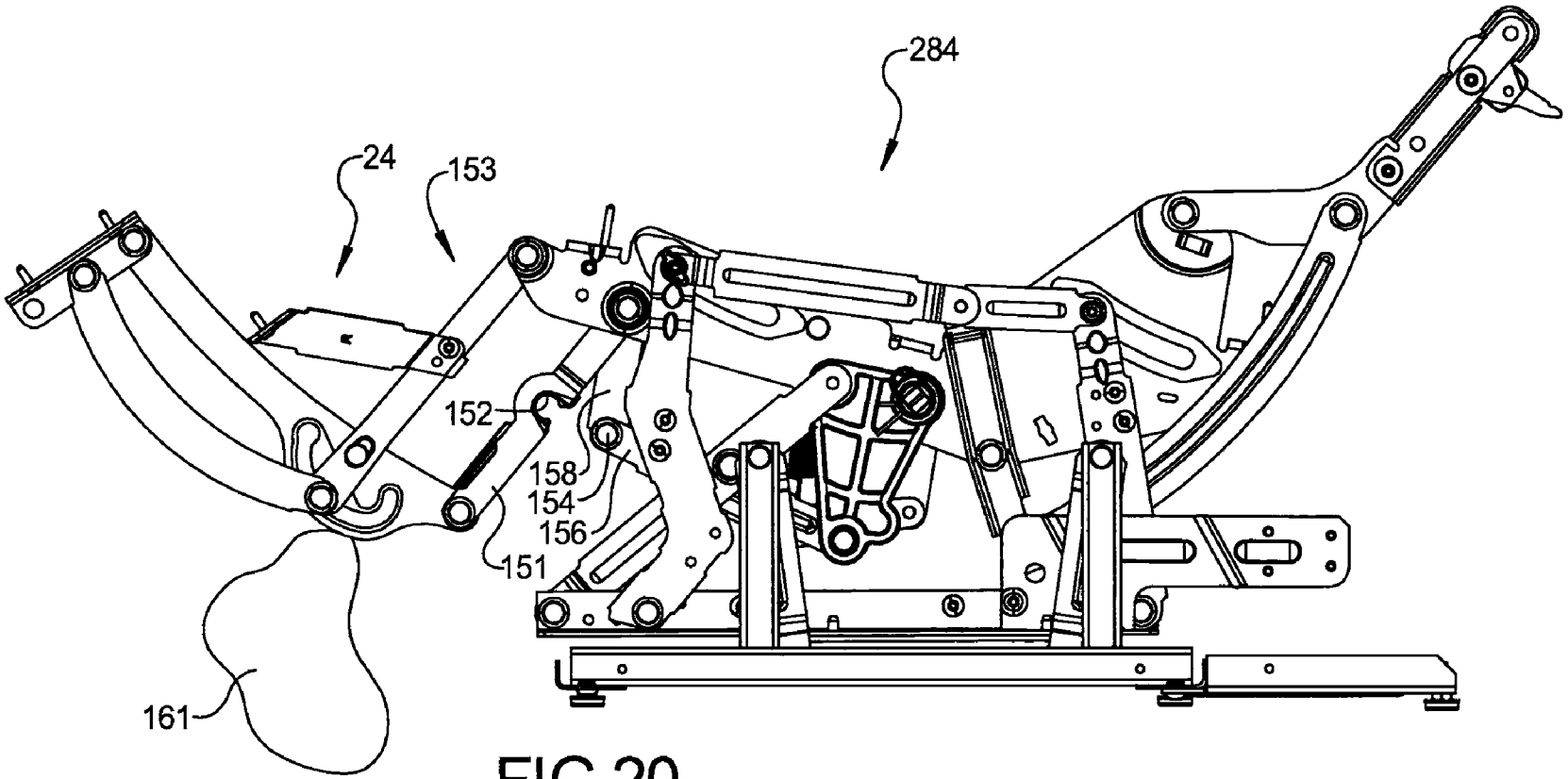
FIG. 20 is a side elevational view of a furniture member glider mechanism having a release system similar to FIG. 9.

Referring to FIG. 20 and again to FIGS. 10 and 16, either release system 153 or release system 284 (not shown in FIG. 20 for clarity) can be used with a glider mechanism 284. Either release system 153 or release system 284 can also be used with a rocking mechanism such as shown in FIG. 10, or with a wall proximity mechanism such as shown in FIG. 16. Either release system 153 or release system 284 can further be used with a power actuated mechanism such as shown in FIGS. 10 and 16, or with a manually actuated mechanism.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A release system for a furniture member leg rest assembly extended from an actuation mechanism, comprising:

the actuation mechanism including a leg rest assembly movable between a fully retracted and a plurality of extended positions, including a fully extended position;

a pantograph link of the leg rest assembly rotatably connected to the actuation mechanism;

an extension link rotatably connected to the actuation mechanism and moved in extension and retraction directions; and a member in contact with the extension link and in releasable contact with the pantograph link, whereby the member is in contact with the pantograph link when the member is operating to push the pantograph link outward toward the fully extended position, and the member is spatially separable from the pantograph link when an object is contacted by the leg rest assembly during return from any of the extended positions toward the fully retracted position.

2. The release system of claim 1, wherein the pantograph link includes an engagement slot.

3. The release system of claim 2, wherein the member is an engagement pin connected to the extension link, the engagement pin releasably received in the engagement slot during extension of the leg rest assembly when the extension link is displaced in the extension direction, whereas when the object in a return path of the leg rest assembly returning toward the fully retracted position is contacted, the engagement slot permits release of the engagement pin from the engagement slot freeing the leg rest assembly to return by gravity toward the fully retracted position after removal of the object from the return path.

4. The release system of claim 1, wherein the member comprises a contact link rotatably connected by a rotational fastener to the extension link, the contact link having a flange contacting the pantograph link operating to push the pantograph link outward toward the fully extended position.

5. The release system of claim 4, further including a biasing member connected to the pantograph link operating to bias the pantograph link and the leg rest assembly toward the fully retracted position.

6. The release system of claim 4, further including a biasing member connected to each of the pantograph link and the actuation mechanism operating to bias the pantograph link and the leg rest assembly toward the fully retracted position.

7. The release system of claim 1, wherein the actuation mechanism comprises a rocking mechanism.

8. The release system of claim 1, wherein the actuation mechanism comprises a wall proximity mechanism.

9. The release system of claim 1, wherein the actuation mechanism comprises a glider mechanism.

10. The release system of claim 1, wherein the actuation mechanism comprises a power actuator.

11. The release system of claim 1, wherein the member comprises a contact link rotatably connected by a rotational fastener to the extension link, the contact link having a flange contacting the pantograph link operating to push the pantograph link outward toward the fully extended position.

12. A release system for a furniture member leg rest assembly, comprising:

an actuation mechanism, the actuation mechanism including a leg rest assembly movable between a fully retracted and a plurality of extended positions inclusive, including a fully extended position;

a pantograph link of the leg rest assembly rotatably connected to the actuation mechanism, the pantograph link having an engagement slot; and an engagement pin connected to the actuation mechanism, the engagement pin releasably received in the engagement slot during extension of the pantograph link and thereby the leg rest assembly when an extension link rotatably connected to the actuation mechanism is displaced, whereas when an obstruction item in a return path of the leg rest assembly returning toward the fully retracted position is contacted, the engagement slot permits release of the engagement pin from the engagement slot freeing the leg rest assembly to return by gravity toward the fully retracted position after removal of the obstruction item from the return path.

13. The release system of claim 12, further comprising a motorized drive assembly connected to the actuation mechanism operating to move the leg rest assembly between the fully retracted position and any of the plurality of extended positions inclusive including the fully extended position upon selection by an occupant of the furniture member.

14. The release system of claim 13, wherein the actuation mechanism further includes a drive rod rotatably connected to the extension link and movable by the drive assembly to extend and retract the leg rest assembly.

15. The release system of claim 14, wherein the actuation mechanism further includes a leg rest lock link rotatably connecting the drive rod to the extension link.

16. The release system of claim 12, wherein the engagement slot further includes opposed first and second raised shoulders defining a shoulder clearance span smaller than a diameter of the engagement pin such that the first and second raised shoulders elastically displace away from each other and snap back into position upon entry of the engagement pin into the engagement slot.

17. The release system of claim 16, wherein the first and second raised shoulders define end positions of a wall inner face of the engagement slot such that the wall inner face defines a semi-spherical geometry having an arc of rotation greater than 180°.

18. The release system of claim 12, further including a polymeric member coupled to the pantograph link, the polymeric member having the engagement slot created therein.

19. The release system of claim 12, wherein the engagement pin is fixedly connected to an extension link of the actuation mechanism.

20. A release system for a furniture member leg rest assembly extended from an actuation mechanism, comprising:

the actuation mechanism including a leg rest assembly movable between a fully retracted and a plurality of extended positions inclusive, including a fully extended position;

a pantograph link of the leg rest assembly rotatably connected to the actuation mechanism;

an extension link rotatably connected to the actuation mechanism and moved in extension and retraction directions; and a contact link rotatably connected by a rotational fastener to the extension link, the contact link having a flange releasably contacting the pantograph link and operating to push the pantograph link outward toward the fully extended position when the extension link is moved in the extension direction, the flange of the contact link being spatially separable from the pantograph link when an object is contacted by the leg rest assembly when the extension link is moved in the retraction direction and during return from any of the extended positions toward the fully retracted position.

21. The release system of claim 20, further including a biasing member connected to the pantograph link biasing the pantograph link and the leg rest assembly toward the fully retracted position.

22. The release system of claim 21, wherein the actuation mechanism further includes a drive rod rotatably connected to the extension link and movable by the drive assembly to extend and retract the leg rest assembly.

23. The release system of claim 22, wherein the actuation mechanism further includes a lock link rotatably connecting the drive rod to the extension link, the biasing member having a hook end engaged with the lock link.

24. The release system of claim 21, wherein the biasing member includes a hook end engaged with a fastener extending from the pantograph link.

25. The release system of claim 21, wherein the biasing member comprises a tension spring.

26. A release system for a furniture member leg rest assembly, comprising:

an actuation mechanism including an extendable and retractable leg rest assembly;

an electrically powered drive assembly connected to the actuation mechanism operating to move the leg rest assembly between a retracted position and any of a plurality of extended positions inclusive including a fully extended position;

a pantograph link of the leg rest assembly rotatably connected to the actuation mechanism;

an extension link rotatably connected to the actuation mechanism and moved in extension and retraction directions; and a member in contact with the extension link and in releasable contact with the pantograph link, whereby the member is in contact with the pantograph link when the member is operating to push the pantograph link outward toward the fully extended position, and the member is spatially separable from the pantograph link when an object is contacted by the leg rest assembly during return from any of the extended positions toward the fully retracted position.

27. The release system of claim 26, wherein the pantograph link includes an engagement slot.

28. The release system of claim 27, wherein the member is an engagement pin connected to the extension link, the engagement pin releasably received in the engagement slot at least during powered extension of the leg rest assembly, wherein when an obstruction item in a return path of the leg rest assembly moving toward the retracted position is contacted, the engagement pin is released from the engagement slot allowing the leg rest assembly to return by gravity toward the retracted position after removal of the obstruction item from the return path.

* * * * *